US005252885A

United States Patent [19]

Muzeroll et al.

[11] Patent Number: 5,252,885

[45] Date of Patent: * Oct. 12, 1993

[54] METAL HALIDE ARC DISCHARGE LAMP ASSEMBLY

[75] Inventors: Martin E. Muzeroll, Merrimack; Simone P. Bazin, Bedford; Norman A. Mathieu, Durham; Ronald C. Lekebusch, Goffstown; Edward H. Nortrup, Bedford, all of N.H.

[73] Assignee: GTE Products Corporation, Danvers, Mass.

[ * ] Notice: The portion of the term of this patent subsequent to Aug. 4, 2009 has been disclaimed.

[21] Appl. No.: 757,084

[22] Filed: Sep. 10, 1991

Related U.S. Application Data

[63] Continuation of Ser. No. 539,752, Jun. 18, 1990, Pat. No. 5,136,204, which is a continuation-in-part of Ser. No. 449,024, Dec. 11, 1989, abandoned.

[51] Int. Cl.[5] ..... H01J 17/16; H01J 61/30

[52] U.S. Cl. ..... 313/25; 313/634

[58] Field of Search ..... 313/25, 634

[56] References Cited

U.S. PATENT DOCUMENTS 2,080,919 5/1937 Ihln et al. ..... 313/25

2,972,693 2/1961 Rosenberg ..... 313/25

*Primary Examiner*—Sandra L. O'Shea

*Attorney, Agent, or Firm*—Joseph S. Romanow; William H. McNeill

[57] ABSTRACT

An electric lamp assembly includes a sealed lamp envelope, a lamp capsule located within the lamp envelope, a cylindrical, light-transmissive shroud surrounding the lamp capsule, and a mounting arrangement for supporting the lamp capsule and the shroud within the lamp envelope. The mounting arrangement includes one or two supports rods parallel to the axis of the shroud and first and second clips for retaining the shroud and the lamp capsule. The clips prevent both axial and lateral movement of the shroud. The clips are attached to the support rods, typically by welding. In a preferred embodiment, a single clip at each end of the shroud retains both the shroud and the lamp capsule, and requires only a single weld to the support rod.

14 Claims, 6 Drawing Sheets

METAL HALIDE ARC DISCHARGE LAMP ASSEMBLY

CROSS REFERENCE TO RELATED APPLICATIONS

This is a continuation of copending application Ser. No. 07/539,752 filed Jun. 18, 1990, which is a continuation-in-part of U.S. Ser. No. 07/449,024 filed Dec. 11, 1989, now abandoned.

FIELD OF THE INVENTION

This invention relates to metal halide arc discharge lamps having light-transmissive shrouds and, more particularly, to structures for mounting the shroud and the arc tube in the lamp assembly.

BACKGROUND OF THE INVENTION

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud which comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases, the shroud is open on one end and has a domed configuration on the other end. Shrouds for metal halide arc discharge lamps are disclosed in U.S. Pat. No. 4,499,396 issued Feb. 12, 1985 to Fohl et al and U.S. Pat. No. 4,580,989 issued Apr. 8, 1986 to Fohl et al. See also U.S. Pat. No. 4,281,274 issued Jul. 28, 1981 to Bechard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

In the aforementioned U.S. Pat. No. 4,580,989, two techniques for mounting the shroud are disclosed. According to one technique, the shroud is retained by two metal straps which encircle the shroud and are welded to a frame. According to the second mounting technique, the open end of the shroud is provided with a pair of diametrically opposite slots. The slots engage a metal strap used for mounting of the arc tube.

While both prior art configurations provide generally satisfactory performance, they have been found to have certain disadvantages, particularly in a high volume production environment. In the construction which utilizes a pair of straps which encircle the shroud, the shroud tends to shift lengthwise and/or rotate in the straps when the lamp is jarred during shipping or handling. In the construction which utilizes a pair of slots for engaging a lamp mounting strap, the shroud is subject to cracking or breakage in the areas of the slots where the shroud contacts the strap. Furthermore, it is necessary to heat treat the shroud in the region of the slots to reduce the possibility of cracking or breakage. The heat treatment step adds to the production cost. Accordingly, it is desirable to provide a metal halide arc discharge lamp wherein the shroud is securely locked in position, while cracking or breakage of the shroud is avoided.

It is a general object of the present invention to provide improved electric lamps and, more particularly, improved metal halide arc discharge lamps.

It is a further object of the present invention to provide an electric lamp assembly wherein a light-transmissive shroud is securely locked in position. It is another object of the present invention to provide a metal halide arc discharge lamp wherein the need for slots in a light-transmissive shroud is eliminated.

It is yet another object of the present invention to provide a metal halide arc discharge lamp having a light-transmissive shroud which is protected against movement, cracking and breakage during shipping and handling.

It is still another object of the present invention to provide a metal halide arc discharge lamp which is low in cost and is easily manufactured.

SUMMARY OF THE INVENTION

According to the present invention, these and other objects and advantages are achieved in an electric lamp assembly comprising a sealed lamp envelope, a lamp capsule located within the lamp envelope for generating light upon application of electrical energy, means for coupling electrical energy through the lamp envelope to the lamp capsule, a generally cylindrical, light-transmissive shroud, and means for mounting the lamp capsule and the shroud within the lamp envelope with the lamp capsule disposed within the shroud. The shroud has at least one open end and typically has both ends open. The mounting means includes clip means for retaining the shroud in a fixed position relative to the lamp envelope and frame means for mechanically coupling the clip means to the lamp envelope.

The clip means includes a first clip which bears against a first end of the shroud and a second clip which bears against a second end of the shroud. The first and second clips retain the shroud between them and prevent axial movement. In addition, the first and second clips include portions which prevent lateral movement of the shroud. The shroud is secured in a fixed position without requiring slots in the ends of the shroud. The clip means can include means for retaining the lamp capsule.

In a preferred embodiment for small and medium lamp sizes, the first and second clips each include a strap having inturned ends, an arcuate portion affixed to one of the inturned ends and a tab affixed to the other of the inturned ends. The arcuate portion encircles a portion of the shroud and prevents lateral movement thereof.

The tab is attached to the frame means. The strap includes portions which bear against the end of the shroud, and the shroud is retained between the inturned ends of the shroud. The clips also include means for retaining the lamp capsule. In a preferred embodiment, spaced-apart projections from the strap retain the lamp capsule between them.

In a preferred embodiment for larger lamp sizes, the first and second clips each include a strap having inturned ends. Each of the inturned ends has an arcuate portion and a tab affixed thereto. The arcuate portions each encircle a portion of the shroud and prevent lateral movement thereof. The tabs are attached, preferably by welding, to the frame means. The strap includes portions which bear against the end of the shroud and prevent axial movement thereof. The shroud is retained between the inturned ends of the strap and between the arcuate portions. The frame means includes a pair of support rods generally parallel to an axis of the shroud and positioned on opposite sides of the shroud. The clips are attached to the support rods to provide a rigid mechanical assembly. The clip preferably includes spaced-apart projections from the strap for retaining the lamp capsule.

In another embodiment of the invention, the first and second clips each include an annular ring portion that bears against the end of the shroud and a flange portion upstanding from the ring portion for preventing lateral movement of the shroud. In a further embodiment of the invention, the first and second clips each include an annular ring portion that bears against the end of the shroud and plural projections from the ring portion for preventing lateral movement of the shroud. In the embodiments including an annular ring, the clips can be attached directly to the frame means or to a strap arrangement used for retaining the lamp capsule.

In still another embodiment of the invention, the first and second clips each include an arcuate band positioned within the shroud adjacent to the end thereof, a plurality of generally U-shaped projections from the arcuate band for engaging the end of the shroud and a tab affixed to one of the projections for attaching the clip means to the frame means.

According to a further embodiment of the invention, the first and second clips each comprise a strap having inturned ends attached to the frame means, a first pair of projections for retaining the lamp capsule, and a second pair of projections which bears against the end of the shroud and prevents lateral movement of the lamp capsule between the first pair of projections. The first and second clips each further include a pair of generally semicircular bands which encircle the shroud and prevent lateral movement thereof.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
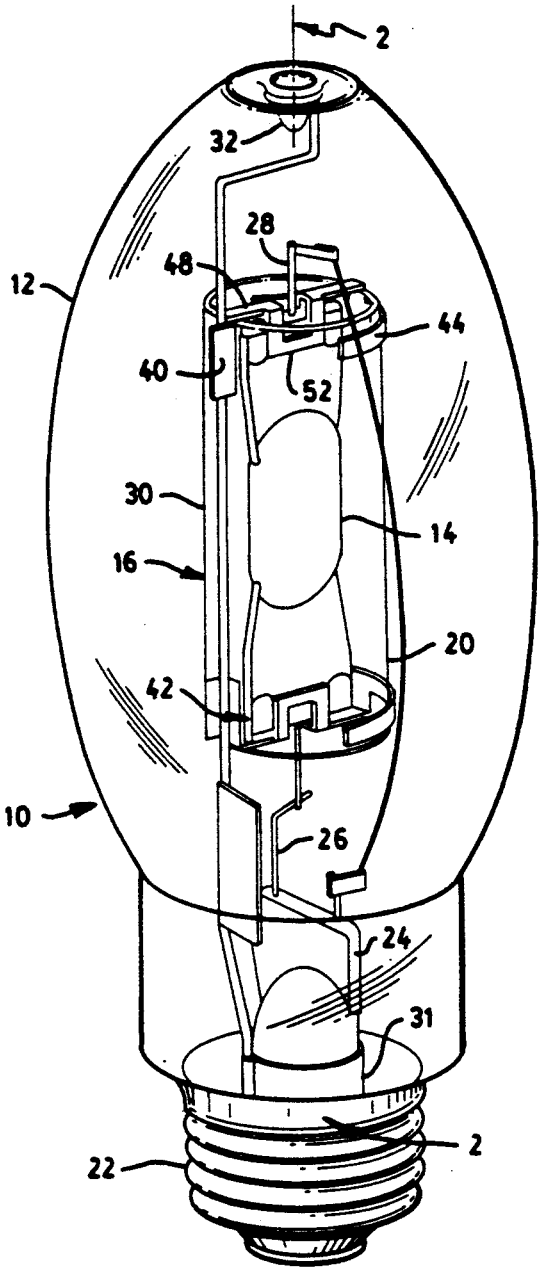
FIG. 1 is a perspective view of a lamp assembly in accordance with a preferred embodiment of the invention.
Figure 2:
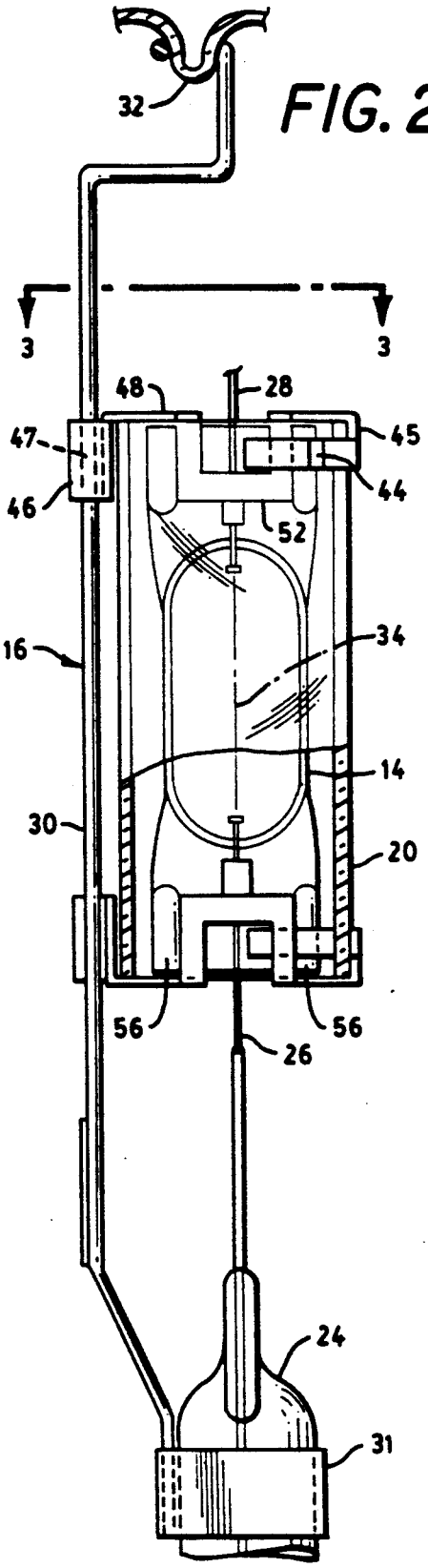
FIG. 2 is an enlarged, partial cross-sectional view showing the lamp capsule, shroud and mounting arrangement taken along the line 2—2 of FIG. 1.
Figure 3:
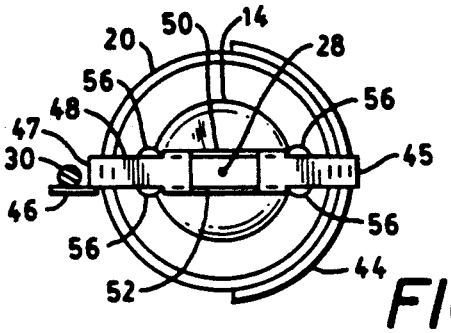
FIG. 3 is a top view showing the lamp capsule shroud and clip taken along the line 3—3 of FIG. 2.
Figure 4:
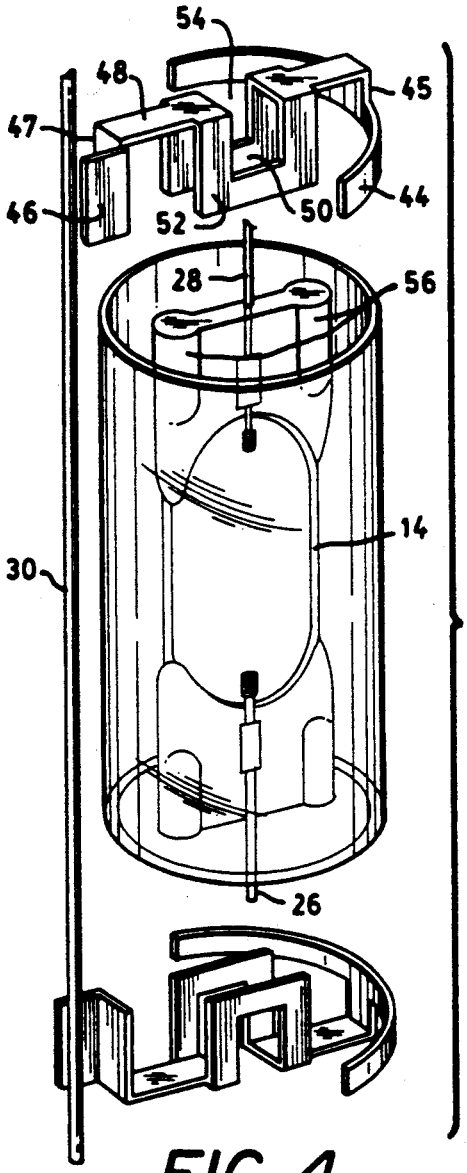
FIG. 4 is an exploded view showing the lamp capsule, shroud and clips of the lamp assembly of FIG. 1.

An electric lamp assembly 10 in accordance with a preferred embodiment of the present invention is shown in FIGS. 1-4. The lamp assembly 10 includes an outer envelope 12 and an arc tube, or lamp capsule 14, mounted within outer envelope 12 by a mounting means 16 to be described in detail hereinafter. The arc tube 14 is positioned within a shroud 20. The shroud 20 is supported in the lamp assembly 10 by the mounting means 16. Electrical energy is coupled to arc tube 14 through a base 22, a stem 24 and electrical leads 26 and 28. Outer envelope 12 is typically formed from blow-molded hard glass. The lamp capsule 14 can be a metal halide arc discharge lamp, a tungsten halogen incandescent capsule or any other lamp capsule which is advantageously operated with a shroud. The shroud 20 comprises a cylindrical tube of light-transmissive, heat-resistant material such as quartz.

The mounting means 16 mechanically supports both the lamp capsule 14 and-the shroud 20 within lamp envelope 12. The mounting means 16 secures lamp capsule 14 and shroud 20 in fixed positions so that they cannot move axially or laterally relative to the remainder of the assembly during shipping and handling or during operation. The mounting means 16 includes a metal support rod 30 attached to stem 24 by a strap 31 and attached to a dimple 32 in the upper end of the lamp envelope 12. The support rod 30 in its central portion is parallel to a central axis 34 of lamp capsule 14 and shroud 20. The mounting means 16 further includes an upper clip 40 and a lower clip 42 which secure both lamp capsule 14 and shroud 20 to support rod 30. In other embodiments to be described hereinafter, the mounting means includes a pair of spaced-apart support rods.

Each of the clips 40 and 42 is formed as an integral metal element including a strap 48 having inturned ends 45 and 47. An arcuate portion 44 is affixed to inturned end 45, and a tab 46 is affixed to inturned end 47. The arcuate portion 44 is formed to encircle approximately half of the circumference of shroud 20. The strap 48 passes over and bears against the end of shroud 20. The spacing between inturned ends 45 and 47 is the same or slightly larger than the outside diameter of shroud 20 so that shroud 20 is retained between inturned end 45 and arcuate portion 44 on one side, and inturned end 47 on the other side. Tab 46 is preferably welded to support rod 30.

The strap 48 is provided with spaced-apart projections 50 and 52 for retaining lamp capsule 14 between them. In the preferred embodiment, the projections 50 and 52 are generally U-shaped portions which are perpendicular to the portion of strap 48 which bears against the end of shroud 20. The projections 50 and 52 are spaced to receive a flattened press seal region of lamp capsule 14. The lamp capsule 14 is provided with dimples 56 which prevent the lamp capsule 14 from moving laterally between projections 50 and 52. The strap 48 includes an opening 54 of sufficient size to provide clearance for electrical lead 28.

The clips 40 and 42 secure both lamp capsule 14 and shroud 20 to frame 30. Only a single weld is required to secure each of the clips 40, 42 to frame 30. The clips 40 and 42 are preferably identical and are formed of sheet metal having a thickness of 0.020 inch.

Figure 6:
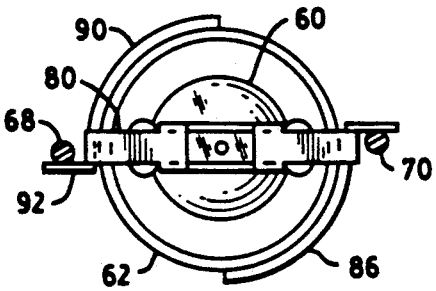
FIG. 6 is a top view showing the lamp capsule, shroud and clip taken along the line 6-6 of FIG. 5.
Figure 5:
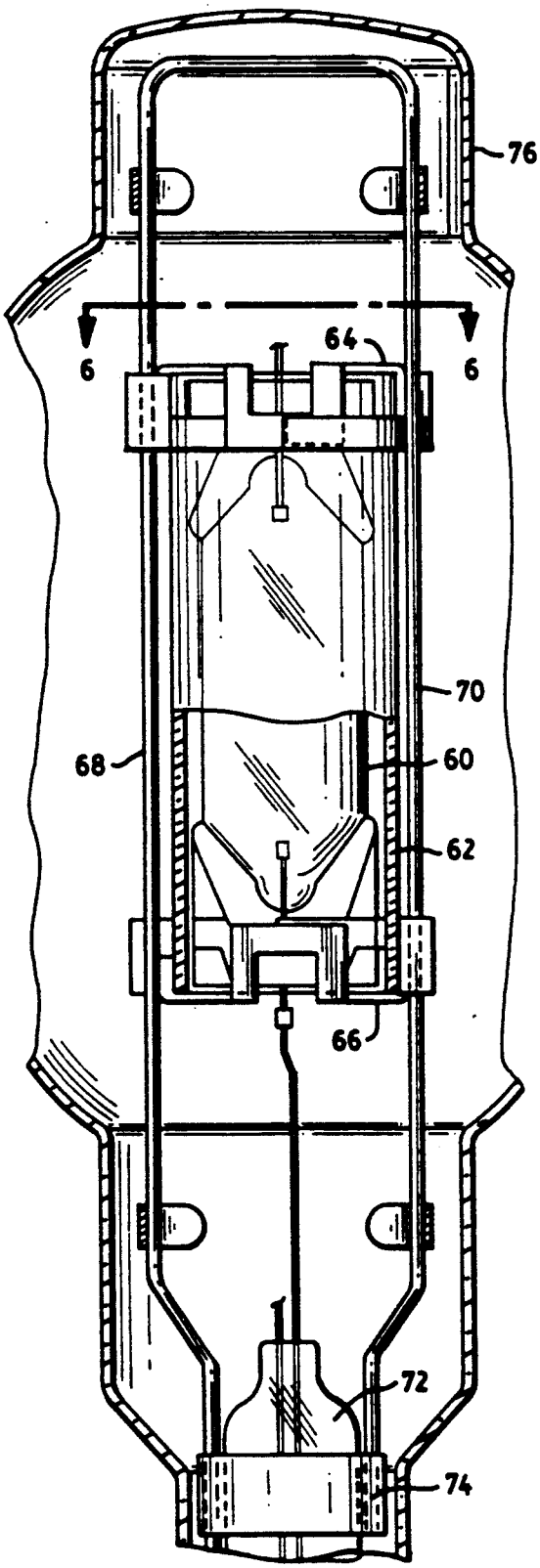
FIG. 5 is a partial cross-sectional view of a lamp assembly in accordance with a second embodiment of the invention.
Figure 7:
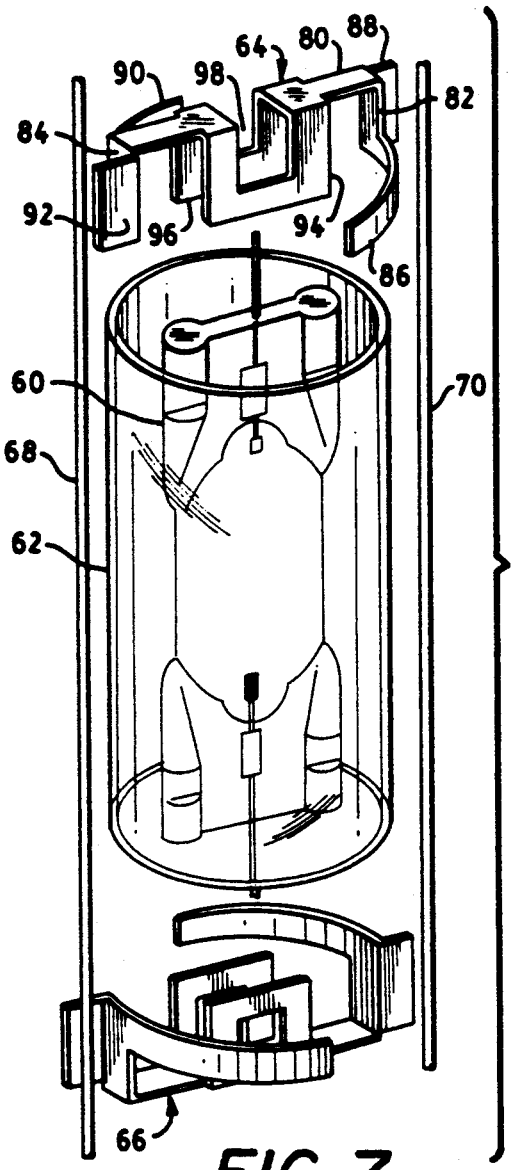
FIG. 7 is an exploded view showing the lamp capsule, shroud and clips of the lamp assembly of FIG. 5.

Another preferred embodiment of the lamp assembly is illustrated in FIGS. 5–7. This embodiment is particularly useful for larger size lamps but is not limited to such use. A lamp capsule 60 and a shroud 62 are retained by an upper clip 64 and a lower clip 66. A frame comprises a support rod 68 and a support rod 70. The support rods 68 and 70 are attached to a lamp stem 72 by a strap 74 and are retained in position by the upper portion of lamp envelope 76. The support rods 68 and 70 can be part of a continuous, generally U-shaped support frame. The support rods 68 and 70 are spaced-apart on opposite sides of shroud 62 and are generally parallel to a longitudinal axis of lamp capsule 60 and shroud 62.

Each of the clips 64 and 66 includes a strap 80 having inturned ends 82 and 84. An arcuate portion 86 and a tab 88 are affixed to inturned end 82. An arcuate portion 90 and a tab 92 are affixed to inturned end 84. The arcuate portions 86 and 90 have a suitable curvature and spacing to partially encircle the shroud 62. The strap 80 bears against the end of shroud 62. The spacing between inturned ends 82 and 84 is the same or slightly larger than the outside diameter of shroud 62 so that the shroud 62 is retained between inturned end 82 and arcuate portion 86 on one side, and inturned end 84 and arcuate portion 90 on the other side. Tabs 88 and 92 are welded to support rods 70 and 68, respectively.

The strap 80 is provided with spaced-apart projections 94 and 96 for retaining the lamp capsule 60 between them. The projections 94 and 96 are preferably generally U-shaped portions which are perpendicular to strap 80. The projections 94 and 96 receive a flattened press seal region of lamp capsule 60 between them. The strap 80 includes an opening 98 of sufficient size to provide clearance for the electrical lead of lamp capsule 60.

Figure 8:
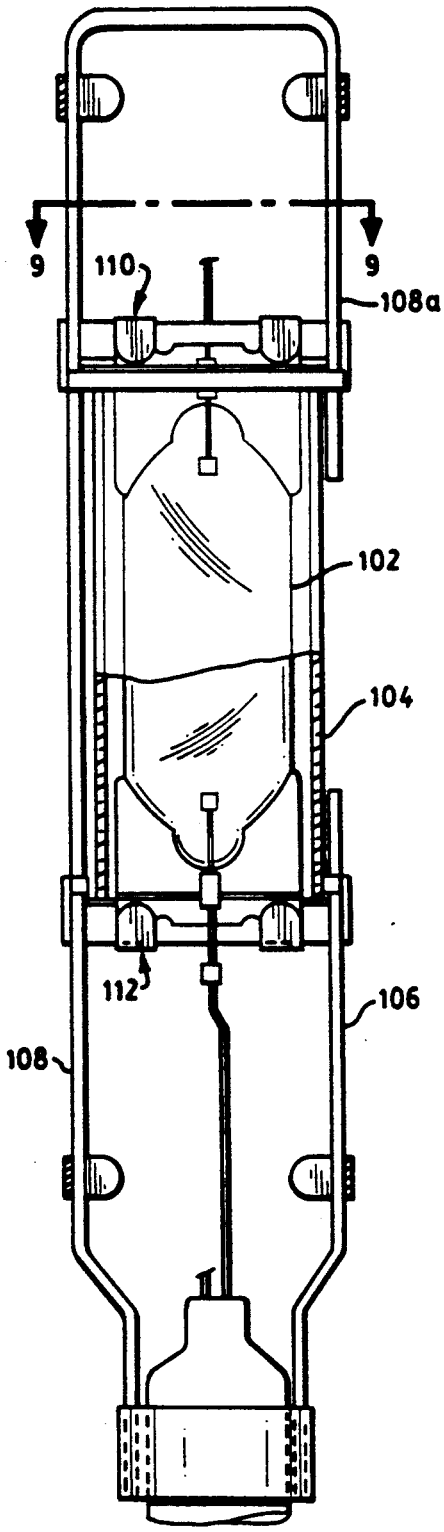
FIG. 8 is an elevational view of a lamp capsule, shroud and mounting assembly in accordance with a third embodiment of the invention.
Figure 9:
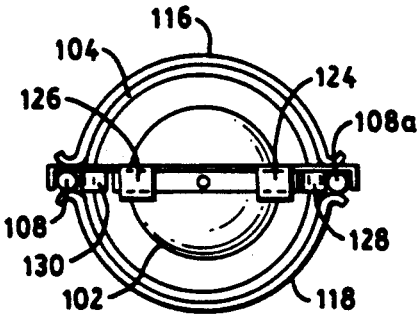
FIG. 9 is a top view showing the lamp capsule, shroud and clip taken along the line 9—9 of FIG. 8.
Figure 10:
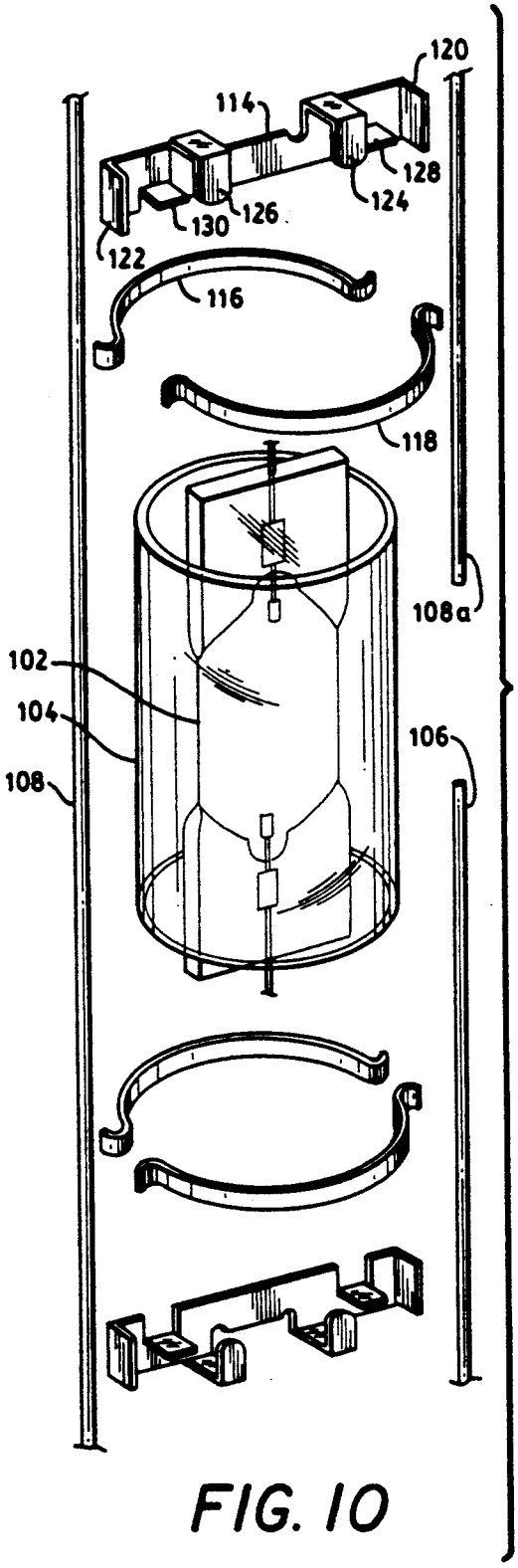
FIG. 10 is an exploded view showing the lamp capsule, shroud and clips of the lamp assembly of FIG. 8.
Figure 11:
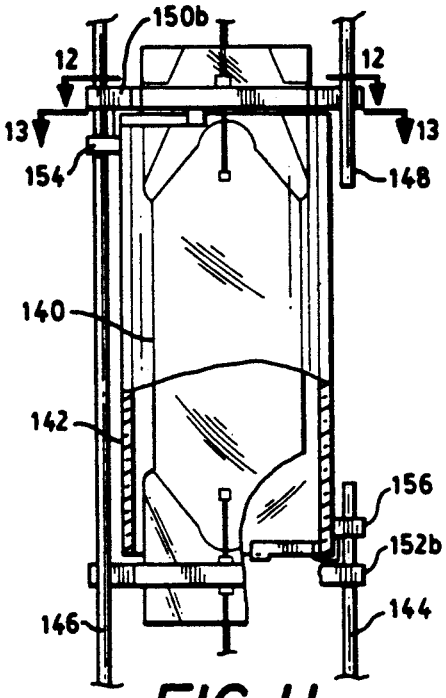
FIG. 11 is a partial elevational view of a lamp capsule, shroud and mounting assembly in accordance with a fourth embodiment of the invention.

A further embodiment of the invention is shown in FIGS. 8–10. A lamp capsule 102 and a shroud 104 are supported in a lamp assembly by support rods 106 and 108, an upper clip means 110 and a lower clip means 112. The support rod 108 is formed into a U-shape at the top of the lamp and includes a portion 108*a*, generally collinear with support rod 106. Each of the clip means 110, 112 includes a strap 114 and arcuate bands 116 and 118. The strap 114 includes inturned ends 120 and 122, spaced-apart L-shaped projections 124 and 126, and tabs 128 and 130. The L-shaped projections 124 and 126 are dimensioned to fit over the end of a press seal region in lamp capsule 102. The tabs 128 and 130 bear against the end of shroud 104 and also prevent lateral movement of lamp capsule 102 between projections 124 and 126. The inturned ends 120 and 122 of strap 114 are welded to support rods 108*a* and 108, respectively. Band 118 is welded to support rods 108 and 108*a*, and band 116 is welded to strap 114. The bands 116 and 118 prevent lateral movement of shroud 104.

Yet another embodiment of the present invention is shown in FIGS. 11–14. A lamp capsule 140 and a shroud 142 are supported in an electric lamp assembly by support rods 144, 146 and 148. The lamp capsule 140 is retained in position by upper straps 150*a* and 150*b* and lower straps 152*a* and 152*b*. The shroud 142 is retained by upper clip 154 and a lower clip 156.

Figure 12:
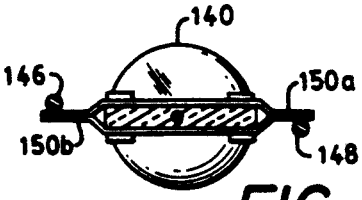
FIG. 12 is a cross-sectional view taken along the line 12—12 of FIG. 11.
Figure 13:
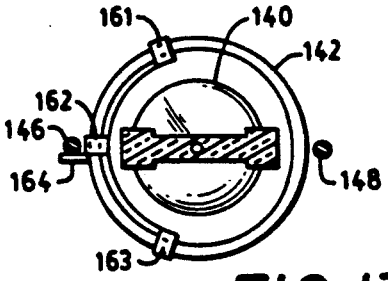
FIG. 13 is a cross-sectional view taken along the line 13—13 of FIG. 11.
Figure 14:
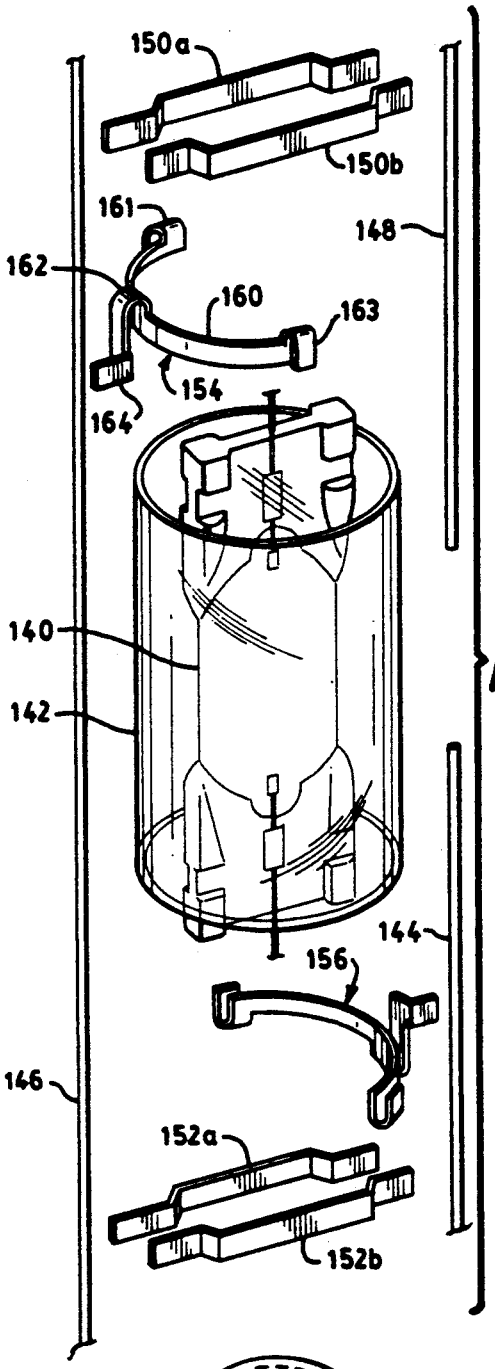
FIG. 14 is an exploded view showing the lamp capsule, shroud and clips of the lamp assembly of FIG. 11.

As best shown in FIG. 12, straps 150*a* and 150*b* are metal strips which are positioned on opposite sides of a press seal region of lamp capsule 140 and are welded together. The ends of straps 150*a* and 150*b* are welded to support rods 146 and 148 to thereby retain lamp capsule 140 between them.

Each of the clips 154 and 156 comprises an arcuate band 160 having generally U-shaped projections 161, 162 and 163 spaced along its length. The projection 162 is elongated and is provided with a tab 164. More or fewer projections can be provided as necessary. The clip 154 is positioned with band 160 on the inside circumference of shroud 142 and with projections 161, 162 and 163 hooking over the end of shroud 142. The tab 164 is welded to support rod 146. Preferably, upper clip 154 is located on one side of shroud 142 and lower clip 156 is located on the diametrically opposite side of shroud 142 to provide balanced support for shroud 142.

Figure 15:
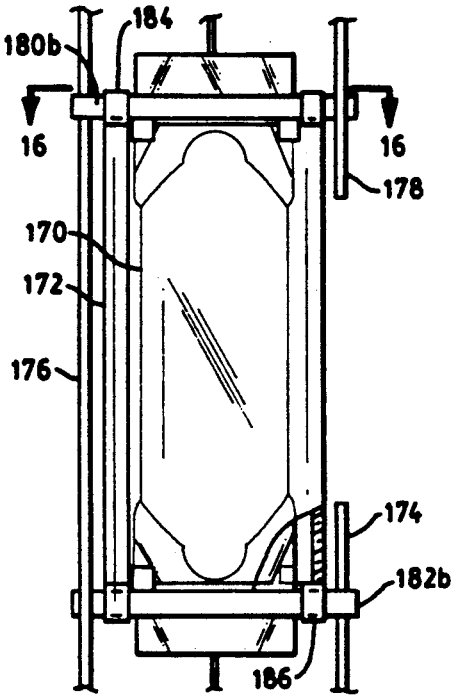
FIG. 15 is a partial elevational view of a lamp capsule, shroud and mounting assembly in accordance with a fifth embodiment of the invention.
Figure 16:
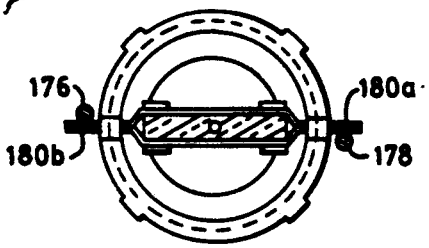
FIG. 16 is a cross-sectional view taken along the line 16—16 of FIG. 15.
Figure 17:
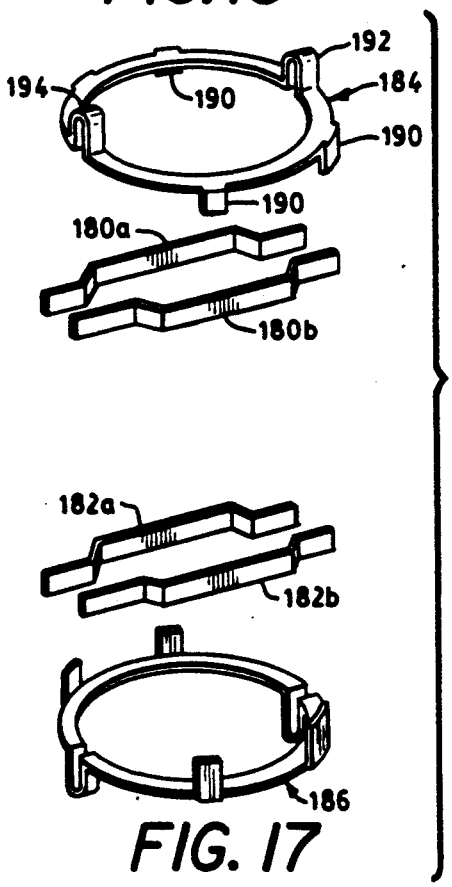
FIG. 17 is an exploded view of the clips used for mounting the lamp capsule and shroud in the assembly of FIG. 15.
Figure 18:
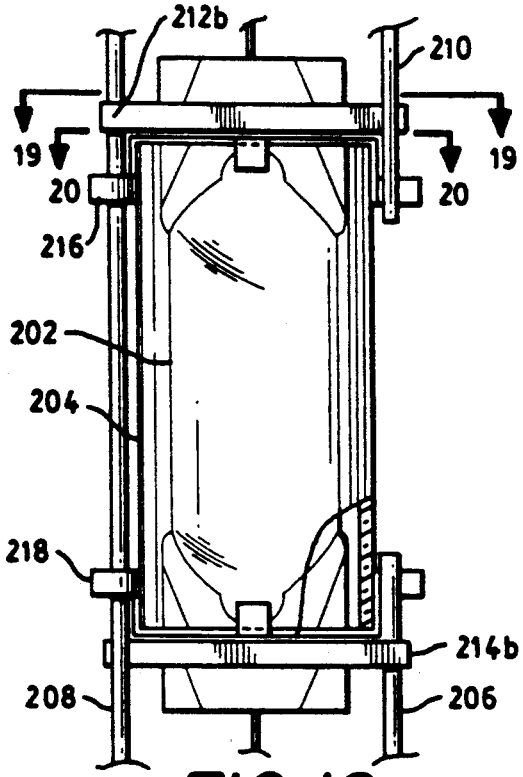
FIG. 18 is a partial elevational view of a lamp capsule, shroud and mounting assembly in accordance with a sixth embodiment of the invention.
Figure 19:
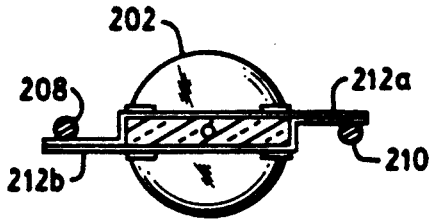
FIG. 19 is a cross-sectional view taken along the line 19—19 of FIG. 18.
Figure 20:
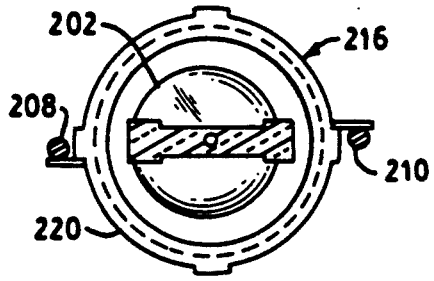
FIG. 20 is a cross-sectional view taken along the line 20—20 of FIG. 18.
Figure 21:
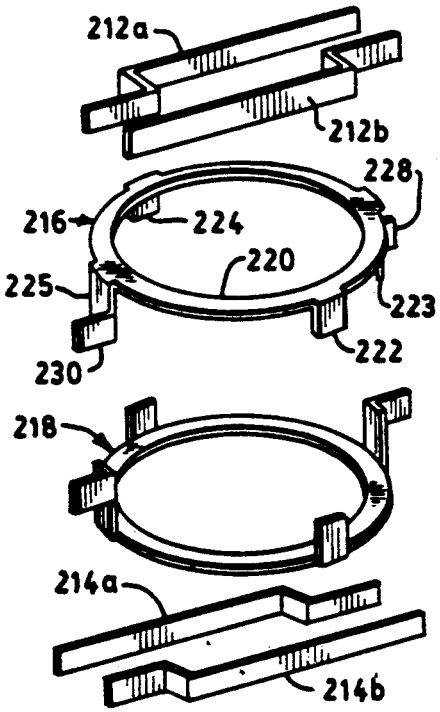
FIG. 21 is an exploded view of the clips used for mounting the lamp capsule and shroud in the assembly of FIG. 18.

A further embodiment of the present invention is shown in FIGS. 15–17. A lamp capsule 170 and a shroud 172 are supported in an electric lamp assembly by support rods 174, 176 and 178. The lamp capsule 170 is retained in position by upper straps 180*a* and 180*b* and lower straps 182*a* and 182*b*. The shroud 172 is retained in position by an upper clip 184 and a lower clip 186.

The straps 180*a* and 180*b* comprise metal strips which are formed to engage a press seal region of lamp capsule 170. The straps 180*a* and 180*b* are positioned on opposite sides of the press seal region and are welded together. The ends of straps 180*a* and 180*b* are welded to support rods 176 and 178 to thereby support lamp capsule 170.

The clips 184 and 186 each comprise an annular ring 188 in a plane perpendicular to the axis of shroud 172. The annular ring 188 includes inturned tabs 190 projecting from the outer periphery of annular ring 188 and diametrically opposed, U-shaped portions 192 and 194. The clip 184 is positioned such that annular ring 188 bears against the end of shroud 172. Tabs 190 are positioned outside and surround shroud 172. The U-shaped portions 192 and 194 slide over straps 180*a* and 180*b* and are welded thereto as best seen in FIG. 16. Thus, the shroud 172 is prevented from moving axially by annular ring 188 and is prevented from moving laterally by tabs 190.

Still another embodiment of the invention is illustrated in FIGS. 18–21. A lamp capsule 202 and a shroud 204 are supported in an electric lamp assembly by support rods 206, 208 and 210. Upper straps 212*a* and 212*b* attach lamp capsule 202 to support rods 208 and 210, and lower straps 214*a* and 214*b* attach lamp capsule 202 to support rods 206 and 208. An upper clip 216 attaches shroud 204 to support rods 208 and 210 and a lower clip 218 attaches shroud 204 to support rods 206 and 208.

The straps 212*a* and 212*b* comprise elongated metal strips which are formed to abut against a press seal region of lamp capsule 202. The straps 212*a* and 212*b* are positioned on opposite sides of lamp capsule 202 and are welded together. The ends of straps 212*a* and 212*b* are welded to support rods 208 and 210.

Each of the clips 216 and 218 comprises an annular ring 220 in a plane perpendicular to the axis of shroud 204. The diameter of annular ring 220 is selected such that it bears against the end of shroud 204 in the assembled lamp. The clip 216 is further provided with inturned projections 222, 223, 224 and 225 which project from the outer periphery of annular ring 220. Diametrically opposed projections 223 and 225 are provided with tabs 228 and 230. The clip 216 is mounted with annular ring 220 bearing against the end of shroud 204 and projections 222, 223, 224 and 225 surrounding the outside of shroud 204. Tabs 228 and 230 are welded to support rods 210 and 208, respectively. The annular ring 220 prevents axial movement of shroud 204, while projections 222, 223, 224 and 225 prevent lateral movement of shroud 204.

Figure 22:
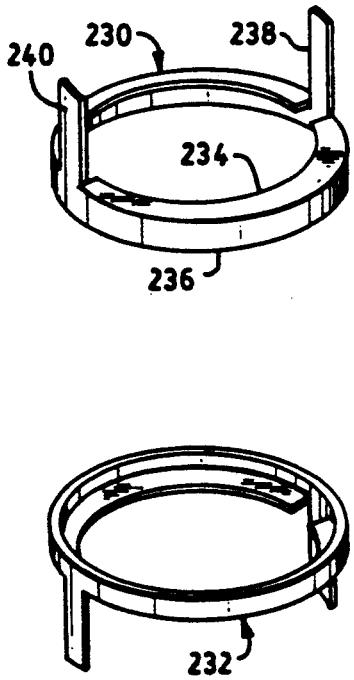
FIG. 22 shows the clips used for mounting of a shroud in accordance with a seventh embodiment of the present invention.

Still another embodiment of clip assemblies for holding a shroud in a lamp assembly in accordance with the present invention, is shown in FIG. 22. An upper clip 230 bears against an upper end of a shroud as shown and described previously, and a lower clip 232 bears against the lower end of a shroud. The clip 230 comprises a generally circular member, having an annular ring 234 in a plane perpendicular to the ax-is of the ring and a flange 236 projecting from the outer periphery of ring 234. The clip 230 further includes upwardly projecting tabs 238 and 240. In use, the clip 230 is positioned at the upper end of a shroud with annular ring 234 bearing against the end of the shroud and flange 236 encircling the outer periphery of the shroud. The tabs 238 and 240 are welded to support rods as shown and described previously. The annular ring 234 prevents axial movement of the shroud, and the flange 236 prevents lateral movement of the shroud.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp assembly comprising:
   - a sealed light-transmissive lamp envelope enclosing an interior;
   - a lamp capsule having at least one end located within said interior for generating light upon application of electrical energy, said capsule having a central axis and a press seal formed in said end;
   - means for coupling electrical energy through said envelope to said capsule;
   - a light-transmissive shroud located within said interior, said shroud surrounding said capsule and having at least one open end;
   - a frame within said interior for supporting said capsule and said shroud, said frame being mechanically mounted on said envelope;
   - capsule mounting means for mounting said capsule securely on said frame, said capsule mounting means including a strap with projections thereon, said strap and projections being adapted to receive and grasp said press seal of said capsule; and
   - shroud mounting means for mounting said shroud securely on said frame.

2. An electric lamp assembly as described in claim 1 wherein said capsule is double ended with a press seal formed in each end and said capsule mounting means grasps each of said press seals of said capsule.

3. An electric lamp assembly as described in claim 1 wherein said strap has L-shaped projections thereof, said strap and L-shaped projections being formed to receive said press seal of said capsule between said strap and L-shaped projections.

4. An electric lamp assembly a described in claim 1 wherein said shroud is cylindrical with two open ends, and said shroud mounting means includes an arcuate band disposed near one end of said shroud and at least partially surrounding said shroud, said band being mounted on said capsule mounting means.

5. An electric lamp assembly as described in claim 1 wherein said shroud is cylindrical with two open ends, and said shroud mounting means includes an arcuate band disposed near one end of said shroud and at least partially surrounding said shroud, said band being mounted on said frame.

6. An electric lamp assembly as described in claim 1 wherein said shroud is cylindrical with two open ends and said shroud mounting means includes two arcuate bands with a pluraliyty of U-shaped projections on each band, each end of said shroud being mounted within said U-shaped projections.

7. An electric lamp assembly as described in claim 1 wherein said shroud is cylindrical with a central axis, said shroud has inner and outer lateral walls and two open ends, said shroud mounting meas includes two annular rings, each of said rings is in a plane substantially perpendicular to said central axis of said shroud, each of said rings has a plurality of inturned tabs, each of said rings contacts one of said ends of said shroud such that movement of said shroud in a direction parallel to said central axis of said shroud is prevented, and each of said inturned tabs contacts a lateral wall of said shroud such that movement of said shroud in a direction perpendicular to said central axis of said shroud is prevented.

8. An electric lamp assembly as described in claim 7 wherein said inturned tabs contact an outside lateral wall of said shroud.

9. An electric lamp as described in claim 7 wherein at least one of said annular rings includes two U-shaped loops formed therein, said capsule mounting means being disposed within said U-shaped loops.

10. An electric lamp assembly as described in claim 1 wherein said shroud is cylindrical with a central axis, said shroud has inner and outer lateral walls and two open ends, said shroud mounting means includes two annular rings, each of said rings is in a plane substantially perpendicular to said central axis of said shroud, each of said rings has an inturned flange extending about a periphery of said ring, said flange is substantially perpendicular to the plane of said ring, each of said rings contacts one of said ends of said shroud such that movement of said shroud is prevented, and each of said inturned flanges contacts a lateral wall of said shroud such that movement of said shroud in a direction perpendicular to said central axis of said shroud is prevented.

11. An electric lamp assembly as described in claim 10 wherein said inturned flanges extend about the outer periphery of said rings.

12. An electric lamp assembly as described in claim 1 wherein said capsule has electrical lead-in wires and said strap includes an opening through which one of said lead-in wires passes such that there is no electrical contact between said lead-in wire and said stap.

13. An electric lamp assembly as described in claim 1 wherein said capsule mounting means includes at least one tab for mountig said capsule mounting means on said frame.

14. An electric lamp assembly as described in claim 1 wherein said shroud mounting means includes at least one tab for mounting said shroud mounting means on said frame.

* * * * *